United States Patent [19]

Haddock et al.

[11] Patent Number: 4,930,209

[45] Date of Patent: Jun. 5, 1990

[54] METHOD FOR ASSEMBLY OF LANYARD AND CONNECTOR

[75] Inventors: John T. Haddock, Lititz; Charles A. Miller, York New Salem; Stanford C. Moist, Jr., Hummelstown; Warren D. Nauman, Elizabethtown; Ronald S. Pala, Mechanicsburg, all of Pa.

[73] Assignee: AMP Incorporated, Harrisburg, Pa.

[21] Appl. No.: 380,225

[22] Filed: Jul. 14, 1989

Related U.S. Application Data

[62] Division of Ser. No. 326,762, Mar. 21, 1989, Pat. No. 4,881,911.

[51] Int. Cl.[5] ..... H01R 43/00

[52] U.S. Cl. ..... 29/592.1; 439/258

[58] Field of Search ..... 439/484, 255, 257, 258, 439/314, 149, 152, 153, 154, 155, 157; 29/854, 857, 825, 592.1, 428, 425, 557, 426.5, 433, 445, 432.1, 434

[56] References Cited

U.S. PATENT DOCUMENTS

| | | | |
|---|---|---|---|
| 3,049,690 | 8/1962 | Sparber | 439/258 |
| 3,458,850 | 7/1969 | Calisher | 439/258 |
| 3,496,519 | 2/1970 | Vetter | 439/258 |
| 3,720,904 | 3/1973 | De Sio . | |
| 3,888,559 | 6/1975 | Geib . | |
| 4,138,181 | 2/1979 | Hacker et al. | 439/258 |
| 4,166,664 | 9/1979 | Herrmann, Jr. . | |
| 4,189,828 | 2/1980 | Chadwick, Jr. | 29/426.5 |
| 4,362,348 | 12/1982 | Stephenson et al. | 439/258 |
| 4,379,361 | 4/1983 | Webster et al. | 29/857 |
| 4,620,759 | 11/1986 | Vetter | 439/157 |
| 4,684,192 | 8/1987 | Long et al. . | |
| 4,787,866 | 11/1988 | Morningstar et al. . | |

*Primary Examiner*—William Briggs
*Attorney, Agent, or Firm*—Gerald K. Kita

[57] ABSTRACT

An electrical connector 6 comprises, an insulative housing block 7 containing multiple, spaced apart, conductive electrical contacts 9 for connection with corresponding conductors 3 of electrical wiring 2, and for disconnect coupling with corresponding multiple electrical terminals 14 arranged in an array, the housing block 7 includes at least one recess 16 without an electrical contact therein, said recess 16 is open for pluggable receipt of a corresponding said electrical terminal 14, a flexible lanyard 18 extends in a loop 19, said loop 19 is anchored to said housing block 7, and said loop 19 extends into said recess 16 and is anchored therein.

6 Claims, 3 Drawing Sheets

METHOD FOR ASSEMBLY OF LANYARD AND CONNECTOR

This application is a Divisional of Application Ser. No. 07/326,762 filed Mar. 21, 1989 U.S. Pat. No. 4,881,911.

FIELD OF THE INVENTION

The invention relates to a connector for a cable assembly, and especially such a connector that is easily disconnected from an array of electrical terminals.

BACKGROUND OF THE INVENTION

A known electrical connector is disclosed in U.S. Pat. No. 4,379,361, and comprises, an insulative housing block containing multiple, spaced apart, conductive electrical contacts for connection with corresponding conductors of electrical wiring, for example, wiring in the form of an electrical cable. The combination of the cable, together with the connector, is known as a cable assembly. The connector is adapted for disconnect coupling with corresponding multiple electrical terminals arranged in an array. The terminals of the array may comprise conductive pins projecting from a surface of a printed circuit board, PCB, as disclosed in U.S. Pat. No. 4,787,866. The pins are in an array wherein the pins are spaced apart closely. Multiple electrical connectors coupled to the pins are very close to one another and are difficult to grasp and disconnect from corresponding pins.

The known connector, known from the patent, is adapted for fitting among a plurality of like connectors. Because the connectors are close together, each one is difficult to grasp and to disconnect from corresponding pins. The known connector utilizes locking type electrical contacts for locking onto corresponding pins To disconnect the known connector, the connector features a moveable housing that deflects the locking type contacts to unlock them from the pins.

Another connector is known from U.S. Pat. No. 4,379,361, and includes a pull tab that assists in disconnecting the connector from corresponding pins. The tab is secured against wiring that is connected to corresponding contacts of the connector. When the tab is pulled, a pulling force is undesirably applied to the wiring, which tends to separate the wiring from their points of connection with corresponding contacts The pull tab of the connector extends parallel to a row of wiring. The pull tab projects beside the row and can flop over to cover the connector or to lie over the wiring. Accordingly, the pull tab is inconveniently positioned for grasping, which leads to thoughtless grasping and pulling on the wiring to disconnect the connector.

SUMMARY OF THE INVENTION

An objective of the invention is to provide an electrical connector that is easily disconnected from an array of electrical terminals. The connector comprises, an insulative housing block containing multiple, spaced apart, conductive electrical contacts for connection with corresponding conductors of electrical wiring, for example, wiring in the form of an electrical cable.

A feature of the invention is a lanyard that extends in a loop from a connector. An advantage is that the loop is open, and thereby is easily grasped and pulled to disconnect the connector from corresponding electrical terminals.

A further feature of the invention is that the lanyard is flexible and extends in a loop that is anchored to a housing block of a connector. Further, the loop is aligned with a row of contact receiving cavities to lie in repose against a row of conductors of electrical wiring connected to contacts within the cavities. An advantage is that the lanyard exerts a pulling force on the housing rather than on the wiring. Another advantage is that the loop consumes very little surface area of the housing block, since the loop is near the row of conductors where the loop and the row emerge from a surface of the housing block.

A further feature of the invention is a housing block that includes at least one recess without an electrical contact therein, said recess is open for pluggable receipt of a corresponding electrical terminal, the flexible lanyard extends in a loop, said loop is anchored to said housing block, and said loop extends into said recess and is anchored therein.

These and other advantages, features and objectives of the invention are disclosed by way of example from the following detailed description and accompanying drawings.

Figures 1, 2:
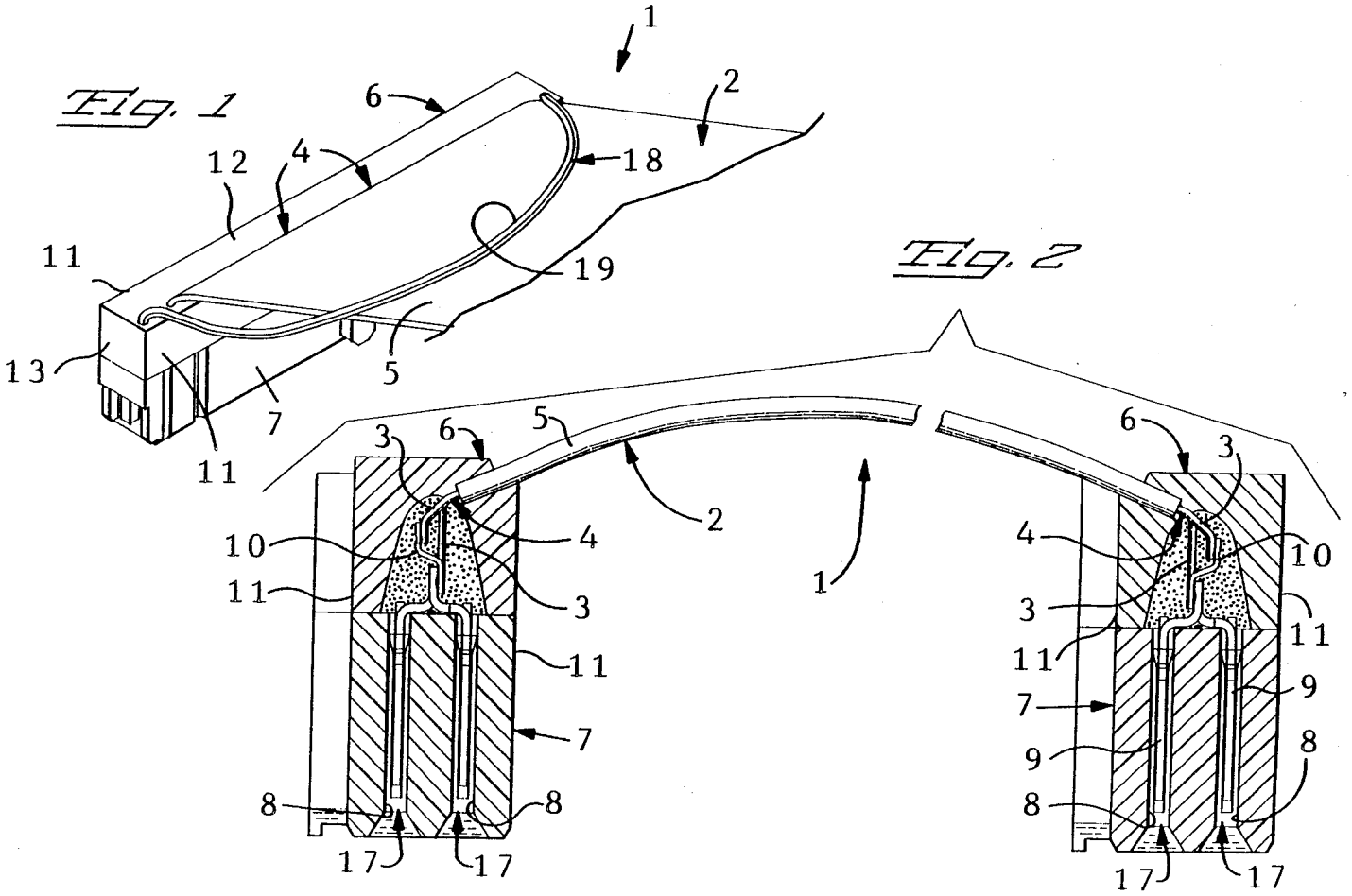
FIG. 1 is a fragmentary perspective view of part of a cable assembly illustrating a lanyard
FIG. 2 is a fragmentary view of a cable assembly with each of a pair of connectors in section
Figure 3:
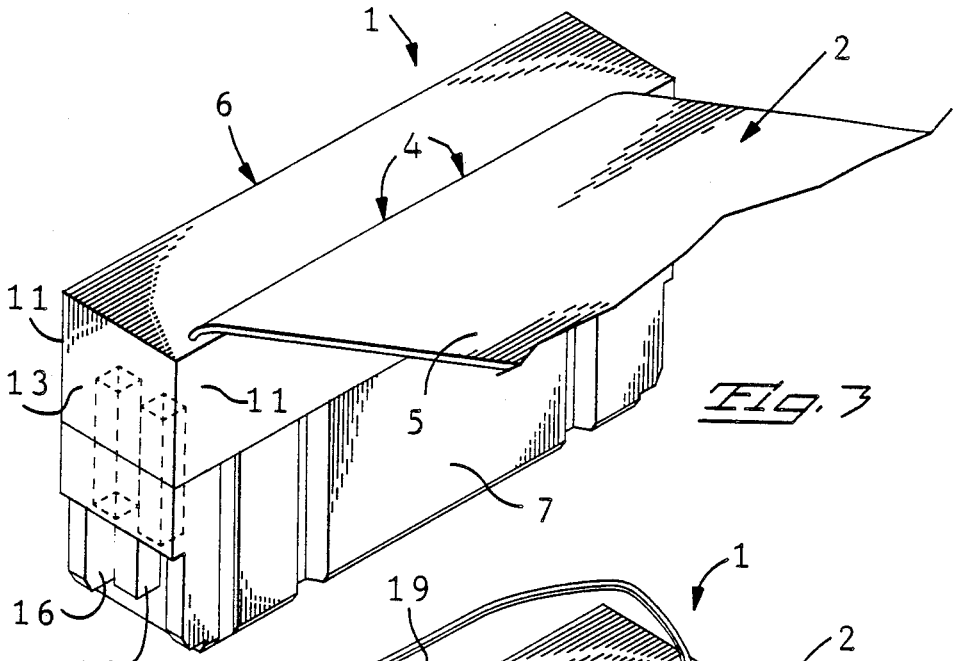
FIG. 3 is an enlarged view similar to FIG. 1 and illustrating in hidden lines cavities of a housing block.

Features of the invention will be described with reference to the drawings According to FIG. 2, a cable assembly 1 includes, electrical wiring 2, for example, in the form of a flexible flat cable with multiple conductors 3, in a row 4 of the conductors 3, within insulative material 5, and an electrical connector 6 at each end of the wiring 2. Each connector 6 comprises, a corresponding insulative housing block 7, multiple contact receiving cavities 8 distributed in an array in each housing block 7 and conductive electrical contacts 9 in corresponding cavities 8. Only some of the cavities 8 and contacts 9 are shown in FIG. 2. The cavities 8 of each housing block 7 are elongated and parallel to one another. Corresponding contacts 9 are connected to corresponding conductors 3, either directly to corresponding ones of the conductors 3 or indirectly, by being connected to a conductive bus bar 10 that, in turn, is connected to corresponding ones of the conductors 3. Each housing block 7 is provided with opposite elongated sides 11, 11, with the wiring 2 of the row 4 of the conductors 3 emerging from an exterior surface 12 of the housing block 7 and projecting from the housing block 7 along one of the selected sides 11, 11. Each housing block 7 is provided with opposite ends 13, 13, with each end 13 joining the sides 11, 11. Further details of the cable assembly 1 are disclosed in U.S Patent application 210,685, filed June 23, 1988 now U.S. Pat. No. 4,834,674.

Figure 4:
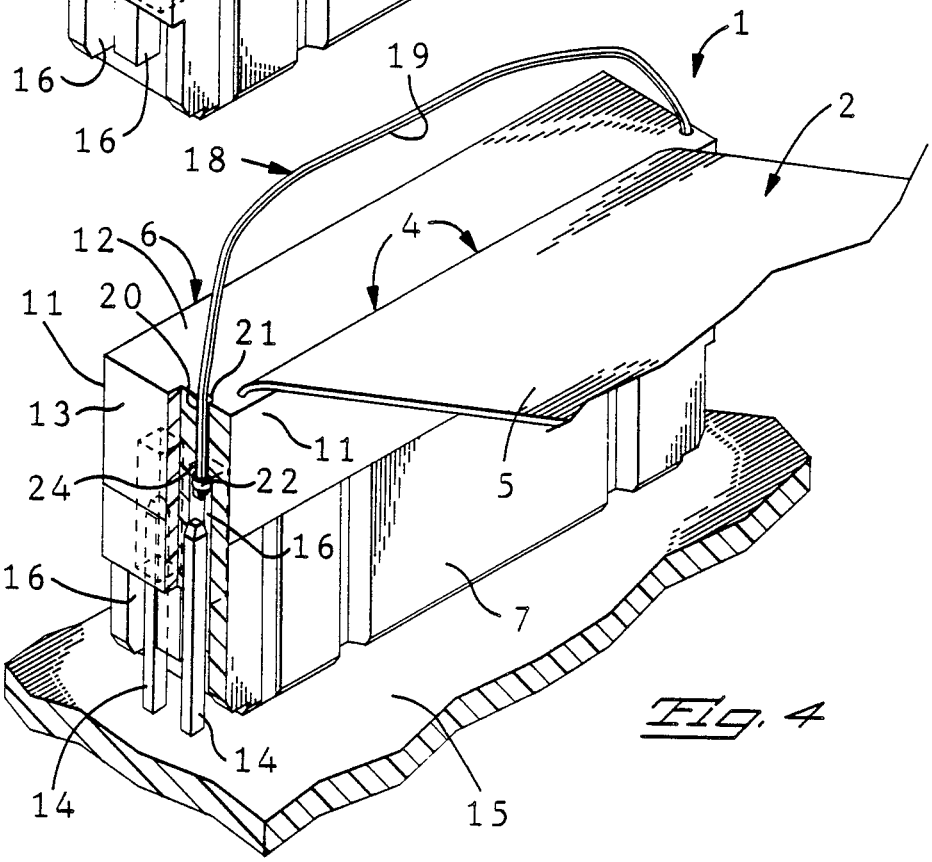
FIG. 4 is a view similar to FIG. 3, and illustrating terminals projecting from a printed circuit board and a housing block partially cut away and a lanyard and a terminal received in a recess of the housing block.

Each connector 6 is adapted for coupling to electrical terminals 14, for example, terminals 14 in the form of conductive pins 14, some of which are shown in FIG. 4, projecting from a printed circuit board 15 and arranged in an array of such pins 14. The cavities 8 of the housing block 7 are open for pluggable receipt therein of corresponding terminals 14 for disconnect coupling to corresponding contacts 9.

With reference to FIG. 4, one end 13 of the housing block 7 is shown. The following description is understood to apply to each end 13 of the housing block 7. With reference to FIG. 4, representative, corresponding recesses 16, 16 are illustrated without corresponding contacts 9 therein. The recesses 16, 16 are in the housing block 7 and are at the ends 13 of the housing block 7. The recesses 16, 16 are open for pluggable receipt therein of corresponding terminals 14,14. The recesses 16, 16 are distributed in the array of the cavities 8 such that the recesses 16, 16 pluggably receive therein corresponding terminals 14,14 when the cavities 8 pluggably receive corresponding terminals 14,14. In the housing block 7, the cavities 8 are arranged in two rows of cavities 8, each pair of the recesses 16, 16 at opposite ends 13 are aligned with corresponding rows 17 of cavities 8 and are located at opposite ends of corresponding rows of cavities 8. The recesses 16, 16 also may be selected cavities 8 without corresponding contacts 9 therein. The corresponding contacts 9 are eliminated from such cavities 8.

With reference to FIG. 4, each housing block 7 is provided with a flexible lanyard 18 in the form of an elongated fibrous cord that extends in an open loop 19 from a corresponding housing block 7. The lanyard 18 facilitates disconnection of the housing block 7 from corresponding terminals 14 by grasping the loop 19 and exerting a pulling force on the loop 19 to pull on the corresponding housing block 7, and thereby, disconnect the corresponding contacts 9 and the entire connector 6 from corresponding terminals 14.

Figure 5:
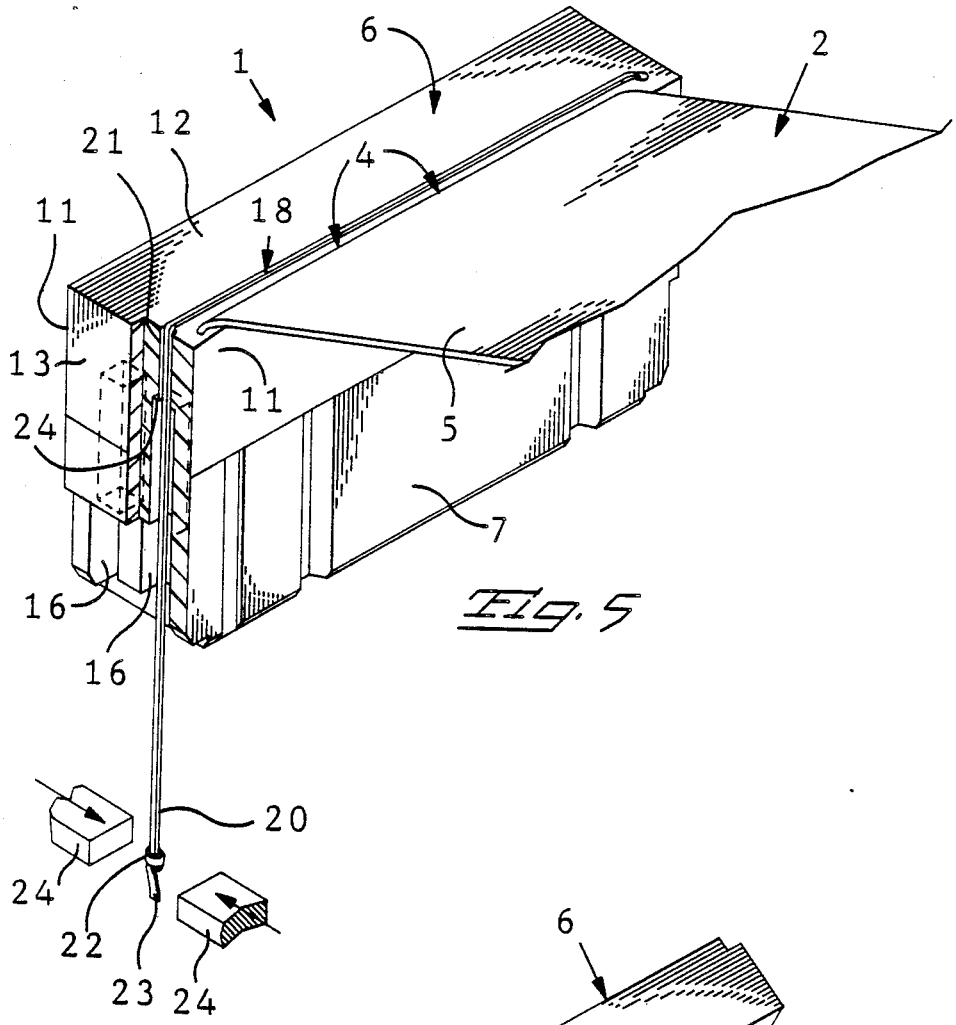
FIG. 5 is a view similar to FIG. 3 and illustrating a housing block partially cut away and schematically illustrating jaws for compressing a knot in a lanyard.

With reference to FIGS. 4 and 5, ends 20 of the loop 19 extend along elongated, corresponding passages 21 that extend from corresponding recesses 16, 16 to the surface 12. For example, the passages 21 are made by drilling into the housing block 7. The passages 21 are parallel to corresponding lengths of the cavities 8 and are aligned with a corresponding row of the cavities 8 and are at ends of the corresponding row of the cavities 8. The ends 20 of the loop 19 are extended along corresponding passages 21 and corresponding recesses 16, 16. With reference to FIG. 5, the ends 20 are extended further and project outwardly from corresponding recesses 16, 16. The ends 20 are enlarged by corresponding knots 22 at the ends 20. Each of the knots 22 is fabricated by tying the knot 22 at a corresponding end 20. Removable portions 23 of corresponding ends 20 that extend from the corresponding knots 22 are cut away and discarded. The knots 22 are reduced in size by compression thereof between jaws 24, 24 of a tool, such as a pair of pliers. The knots 22 are thus sized smaller to avoid excessive wedging of the knots 22 in the recesses 16, 16, which wedging would tend to crack the housing block 7 adjacent to the recesses 16, 16.

Subsequent to tying a knot along each end 20 of the loop 19, the loop 19 is pulled, and the ends 20 are drawn into the corresponding passages 21 until the knots 22 register against corresponding bottoms 24, 24 of the recesses 16, 16. The knots 22 are too large to be drawn into the passages 21. The loop 19 emerges from the surface 12 of the housing block 7 and extends across the surface 12 parallel to and immediately adjacent to the row 4 of conductors 3 of the wiring 2. The loop 19 is aligned with the row of contact receiving cavities 8 and may lie in repose, FIG. 1 against the row 4 of conductors 3 of electrical wiring 2 connected to contacts 9 within the cavities 8.

Each knot 22 is spaced away from a corresponding terminal 14 received in the recess 16. When the recess 16 is too short, the knot 22 interferes with coupling of the connector 6 with corresponding terminals 14. A too short recess 16 is first lengthened, for example, by drilling in the housing block 7 to reposition the bottom 24 of the recess 16 deeper in the housing block 7.

An advantage is that the lanyard exerts a pulling force on the housing rather than on the wiring 2. Further, the loop 19 consumes very little area of the surface 12, since the loop 19 is near the row 4 of conductors 3 where the loop 19 and the row 4 emerge from the surface 12 of the housing block 7. For example, the remainder of the surface 12 is unobstructed, and thereby is available for engagement by latching arms, not shown, of a known latching header as disclosed in U.S. Pat. No. 4,178,051. The loop 19 extends transversely of the length of the conductors 3 of the wiring 2, and has ends 20 of the loop 19 anchored to the housing block 7 instead of the wiring 2.

The loop 19 is easily grasped by hooking the open loop 19, even when the loop 19 lies in repose against the wiring 2, as shown in FIG. 1. Once the loop 19 is hooked, a pulling force can be exerted on the loop 19, to orient the loop 19 in a position that is erect and extending from the housing block 7 parallel to the lengths of the pins 14, as shown in FIG. 4. The pulling force then will be exerted in a direction to withdraw the contacts 9 from corresponding pins 14 and to uncouple the connector 6 from the corresponding pins 14. Exerting a pulling force on the cable is averted.

Figure 6:
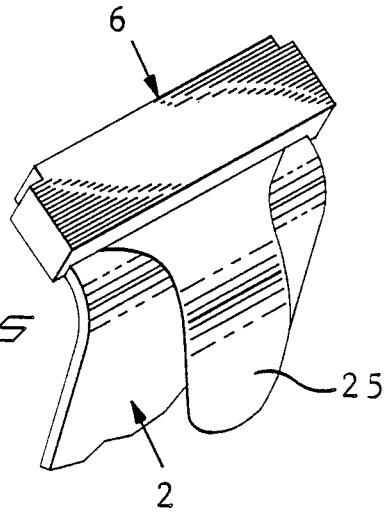
Fig. 6 PRIOR ART
FIG. 6 is a fragmentary perspective view of a connector in which a pull tab is provided.

With reference to FIG. 6, a connector 6 having a housing block 7 and electrical wiring 2 in the form of a flat flexible cable is provided with a flexible pull tab , as described in further detail in U.S. Pat. No. 4,379,361. The pull tab 25 is used for grasping and pulling to disconnect the connector 6 from corresponding electrical terminals, not shown. The pull tab 25 is a solid flap of material that is capable of flopping over to cover the connector 6 or to lie along the wiring 2. Thereby, the pull tab 25 is inconvenient for grasping, which leads to careless grasping and pulling on the cable to disconnect the connector 6.

The previously discussed advantages, features and objectives of the disclosed invention may exist independently of one another, and each contributes to the use and importance of the invention.

We claim:

1. A method of installing a lanyard on a connector, comprising the steps of;

extending a corresponding passage from an exterior surface of a connector to a corresponding recess of the connector, inserting a first end of a lanyard along the corresponding passage, tying a knot in the first end of the lanyard, sizing the knot, extending the lanyard in an open loop across the surface, and anchoring a second end of the lanyard to the connector.

2. A method as recited in claim 1, comprising the steps of; sizing the knot by compressing thereof, the drawing the first end into the corresponding passage until the knot registers against a bottom of the recess.

3. A method as recited in claim 1, comprising the steps of; aligning the recess and the anchored second end of the lanyard with a corresponding row of conductors extending in the surface, and locating the recess and the second end of the lanyard at opposite ends of the row.

4. A method as recited in claim 1, comprising the steps of; drilling the connector to provide the recess.

5. A method as recited in claim 1, comprising the steps of; cutting away and discarding a removable portion of the first end of the lanyard.

6. A method as recited in claim 1, comprising the steps of; anchoring the second end of the lanyard by a knot in the lanyard in another corresponding recess in the connector.

* * * * *

UNITED STATES PATENT OFFICE
CERTIFICATE OF CORRECTION

Patent No. 4,930,209 Dated June 5, 1990

Inventor(s) John T. Haddock, Charles A. Miller, Stanford C. Moist, Jr., Warren D. Nauman, Ronald S. Pala It is certified that error appears in the above-identified patent and that said Letters Patent is hereby corrected as shown below:

In claim 2, column 4, line 68, the second occurrence of the word "the" should be --and--.

Signed and Sealed this

Seventeenth Day of December, 1991

*Attest:*

HARRY F. MANBECK, JR.

*Attesting Officer*

*Commissioner of Patents and Trademarks*